US007586248B2

(12) United States Patent
Lee et al.

(10) Patent No.: US 7,586,248 B2
(45) Date of Patent: Sep. 8, 2009

(54) ELECTRON EMISSION DEVICE, METHOD FOR MANUFACTURING THE DEVICE, AND ELECTRON EMISSION DISPLAY USING THE SAME

(75) Inventors: Chang-Soo Lee, Chunan-si (KR); Kyu-Won Jung, Chunan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 452 days.

(21) Appl. No.: 11/413,779

(22) Filed: Apr. 28, 2006

(65) Prior Publication Data

US 2006/0246813 A1 Nov. 2, 2006

(30) Foreign Application Priority Data

Apr. 29, 2005 (KR) ..... 10-2005-0036107
Sep. 30, 2005 (KR) ..... 10-2005-0091992

(51) Int. Cl.
*H01J 1/02* (2006.01)

(52) U.S. Cl. ..... 313/309; 313/495

(58) Field of Classification Search ..... 313/495, 313/309, 336, 351
See application file for complete search history.

(56) References Cited

U.S. PATENT DOCUMENTS 6,031,250 A * 2/2000 Brandes et al. ..... 257/77
6,515,415 B1 * 2/2003 Han et al. ..... 313/496

* cited by examiner

*Primary Examiner*—Vip Patel
(74) *Attorney, Agent, or Firm*—Christie Parker & Hale LLP

(57) ABSTRACT

A method of manufacturing an electron emission device where the withstanding voltage characteristics are not deteriorated due to carbon remnants. With the method, cathode electrodes, a first insulating layer and gate electrodes are sequentially formed on a substrate. Openings are formed at the gate electrodes and the first insulating layer to partially expose the surface of the cathode electrodes. A conductive layer is formed on the entire surface of the structure of the substrate. Catalytic metal layers are formed on the conductive layer at the locations to be contain electron emission regions. Electron emission regions are formed on the catalytic metal layers by directly growing a carbonaceous material thereon. The conductive layer is patterned to remove the portions thereof overlaid with carbon remnants during the previous step except for the portion placed under the catalytic metal layer.

8 Claims, 5 Drawing Sheets

ELECTRON EMISSION DEVICE, METHOD FOR MANUFACTURING THE DEVICE, AND ELECTRON EMISSION DISPLAY USING THE SAME

CROSS REFERENCE TO RELATED APPLICATIONS

The application claims priority to and the benefit of Korean Patent Applications No. 10-2005-0036107 filed on Apr. 29, 2005 and No. 10-2005-0091992 filed on Sep. 30, 2005, in the Korean Intellectual Property Office, the entire contents of both of which are incorporated herein by reference.

FIELD OF THE INVENTION

The invention relates to an electron emission device which has electron emission regions formed by growing a carbonaceous material on catalytic metal layers, a method of manufacturing the device, and an electron emission display therewith.

BACKGROUND

Generally, electron emission elements are classified, depending upon the kinds of electron sources, into a first type using a hot cathode, and a second type using a cold cathode.

Known among the second type of electron emission elements using a cold cathode are the field emitter array (FEA) type, surface-conduction emission (SCE) type, metal-insulator-metal (MIM) type, and metal-insulator-semiconductor (MIS) type.

The electron emission elements are arranged on a first substrate while forming arrays to make an electron emission device, and the electron emission device is assembled with a second substrate having a light emission unit based on phosphor layers and an anode electrode, thereby constructing an electron emission display.

The FEA-type of electron emission device has electron emission regions, and cathode and gate electrodes as driving electrodes. The FEA-type of electron emission device is based on the principle that when an electric field is applied to the electron emission region under a vacuum atmosphere, electrons are easily emitted from the electron emission region. For this purpose, the electron emission regions are formed with a material having a low work function or a high aspect ratio.

It has been recently studied in the field of the FEA-type of electron emission devices to form the electron emission regions using a carbonaceous material, emitting electrons well even under low voltage conditions.

It is known that carbonaceous materials such as carbon nanotubes, graphite and diamond-like carbon are well adapted for the formation of the electron emission regions. Particularly, the carbon nanotube is spotlighted as an ideal electron emission material as it has an extremely small edge curvature radius of 100 Å, and emits electrons well, even under the application of a low electric field of 1-10V/μm.

Direct growth techniques may be used to form electron emission regions using the carbonaceous material. In order to fabricate an FEA type electron emission device using direct growth techniques, cathode electrodes and a catalytic metal layer are first formed on a substrate. An insulating layer and gate electrodes are then formed on the cathode electrodes and the catalytic metal layer. Openings are formed at the gate electrodes and the insulating layer to expose the catalytic metal layer. A carbonaceous material is grown on the exposed portions of the catalytic metal layer, thereby forming electron emission regions.

However, during the process of growing the carbonaceous material on the catalytic metal layer, carbon remnants may be generated at the unintended area, that is, at the sidewall of the openings of the insulating layer. As the carbon remnants have conductivity, they deteriorate the withstanding voltage characteristics of the cathode and the gate electrodes. In a serious case, the carbon remnants may incur shorts between the cathode and the gate electrodes.

Such problems similarly arise in forming an additional insulating layer and a focusing electrode over the gate electrodes. That is, with the formation of the electron emission regions, the carbon remnants are left at the sidewall of the openings of the additional insulating layer, and deteriorate the withstanding voltage characteristics of the gate and the focusing electrode.

Meanwhile, with the FEA type electron emission device, the cathode electrodes, the catalytic metal layers, the gate electrodes and the focusing electrode are separately formed, each through deposition and patterning, with complicated relevant processing steps.

SUMMARY OF THE INVENTION

In one embodiment of the invention, an electron emission device is provided which prevents the carbon remnants from being left at the non-light emission areas to heighten the withstanding voltage characteristics of the electrodes and to prohibit the occurrence of shorts, a method of manufacturing the device, and an electron emission display therewith.

In another embodiment of the invention, an electron emission device is provided which reduces the steps of patterning the electrodes to enhance the production efficiency, a method of manufacturing the device, and an electron emission display therewith.

According to one embodiment of the invention, a method of manufacturing an electron emission device includes the steps of: (a) sequentially forming cathode electrodes, a first insulating layer and gate electrodes on a substrate; (b) forming openings at the gate electrodes and the first insulating layer to partially expose the surface of the cathode electrodes; (c) forming a conductive layer on the entire surface of the structure of the substrate; (d) forming catalytic metal layers on the conductive layer at the locations to be formed with electron emission regions; (e) forming electron emission regions on the catalytic metal layers by directly growing a carbonaceous material thereon; and (f) patterning the conductive layer to remove the portions of the conductive layer overlaid with carbon remnants during the previous step except for the portion thereof placed under the catalytic metal layer.

In one embodiment, the method may further include, between the (a) and the (b) steps, the steps of: forming a second insulating layer and a focusing electrode on the gate electrodes; and forming openings at the focusing electrode and the second insulating layer. In this case, with the (f) step, all the portions of the conductive layer except for the portion thereof placed under the catalytic metal layer may be removed to form a catalytic buffer layer under the catalytic metal layer.

Alternatively, in one embodiment, the method may further include, between the (a) and the (b) steps, the steps of: forming a second insulating layer on the gate electrodes; and forming openings at the second insulating layer. With the (f) step, the portions of the conductive layer, except for the portions thereof placed under the catalytic metal layer and over the second insulating layer, may be removed to form a catalytic buffer layer under the catalytic metal layer and a focusing electrode over the second insulating layer.

In an embodiment, the growth of the carbonaceous material may be made by either plasma enhanced chemical vapor deposition or thermal chemical vapor deposition.

In one embodiment, the formation of the catalytic metal layers may be made by either thermal deposition or sputtering using a material selected from iron (Fe), nickel (Ni), cobalt (Co) and alloys thereof, and before the growth of the carbonaceous material on the catalytic metal layers, the catalytic metal layers may be etched to form nanometer-sized metallic particles.

In one embodiment, the conductive layer may be formed with a conductive material which may be selectively etched using an etching solution different from that used in etching the catalytic metal layers.

In one embodiment, the patterning of the conductive layer may be made by wet etching, using a conductive layer etching solution. The conductive layer may be over-etched to generate an under-cut at the periphery thereof.

According to another embodiment of the invention, an electron emission device includes a substrate, cathode electrodes formed on the substrate, and gate electrodes formed on the substrate such that the gate electrodes are insulated from the cathode electrodes. Catalytic buffer layers are formed on the cathode electrodes at predetermined locations thereof. Catalytic metal layers are formed on the catalytic buffer layers. Electron emission regions are formed with a carbonaceous material grown from the catalytic metal layers.

In an embodiment, the electron emission regions may be formed with a material selected from carbon nanotubes, graphite, graphite nanofibers, diamonds, diamond-like carbon, and $C_{60}$.

In one embodiment, the catalytic buffer layer may have a peripheral under-cut such that the width of the catalytic buffer layer is substantially smaller than the width of the catalytic metal layer.

In one embodiment, a focusing electrode may be placed over the cathode electrodes and the gate electrodes. The focusing electrode may be formed with the same material as the catalytic buffer layer.

According to still another embodiment of the invention, an electron emission display includes first and second substrates facing each other, cathode electrodes formed on the first substrate, and gate electrodes formed on the first substrate such that the gate electrodes are insulated from the cathode electrodes. Catalytic buffer layers are formed on the cathode electrodes at predetermined locations thereof. Catalytic metal layers are formed on the catalytic buffer layers. Electron emission regions are formed with a carbonaceous material grown from the catalytic metal layers. Phosphor layers are formed on the second substrate. An anode electrode is placed on a surface of the phosphor layers.

DETAILED DESCRIPTION

A method of manufacturing an electron emission device according to an embodiment of the invention will be now explained with reference to FIGS. 1A to 1D.

Figure 1A:
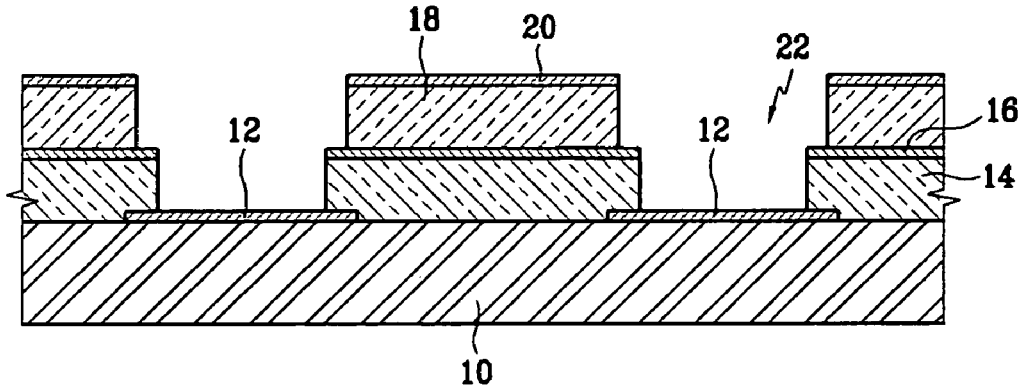
FIGS. 1A to 1D are partial sectional views of an electron emission device according to an embodiment of the invention, illustrating the respective steps of processing an electron emission device.

As shown in FIG. 1A, a conductive layer is formed on a substrate 10, and patterned to thereby form stripe-shaped cathode electrodes 12. An insulating material is deposited or printed onto the cathode electrodes 12 over the entire area of the substrate 10 through chemical vapor deposition or screen printing to form a first insulating layer 14. A conductive layer is formed on the first insulating layer 14, and patterned to thereby form stripe-shaped gate electrodes 16 crossing the cathode electrodes 12.

Thereafter, an insulating material is deposited or printed onto the gate electrodes 16 over the entire area of the substrate 10 through chemical vapor deposition or screen printing to form a second insulating layer 18. A conductive material is coated onto the second insulating layer 18 to form a focusing electrode 20. The focusing electrode 20, the second insulating layer 18, the gate electrodes 16 and the first insulating layer 14 are sequentially partially-etched to thereby form openings 22 partially exposing the cathode electrodes 12.

Figure 1B:
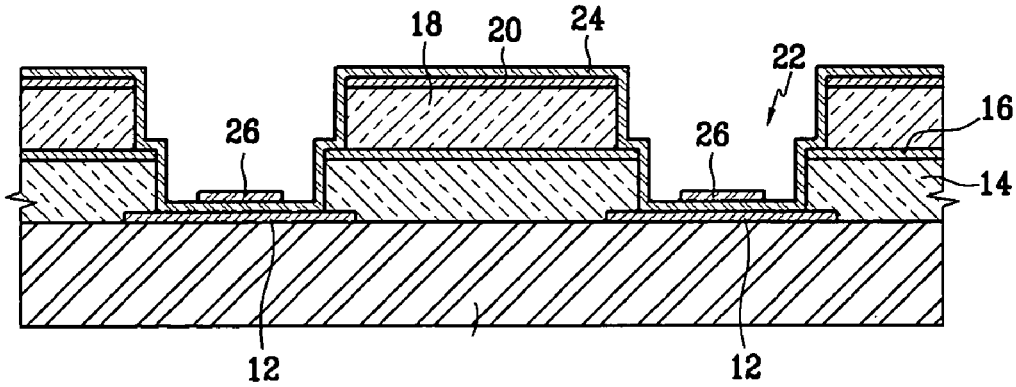

As shown in FIG. 1B, according to an embodiment, a conductive material is coated onto the entire surface of the structure of the substrate 10 to form a conductive layer 24. A catalytic metal material is coated onto the surface of the conductive layer 24 through thermal deposition or sputtering, and patterned to selectively form catalytic metal layers 26 on the cathode electrodes 12 at the locations to be formed with electron emission regions.

In one embodiment, the catalytic metal layer 26 may be formed with iron (Fe), nickel (Ni), cobalt (Co), or an alloy thereof. The conductive layer 24 is formed with a material which may be selectively etched using an etching solution different from that used in etching the catalytic metal layer 26 such that it is not patterned together with the catalytic metal layer 26. In one embodiment, the conductive layer 24 may be formed with a highly conductive material, such as molybdenum (Mo), aluminum (Al), silver (Ag), or chromium (Cr).

Figure 1C:
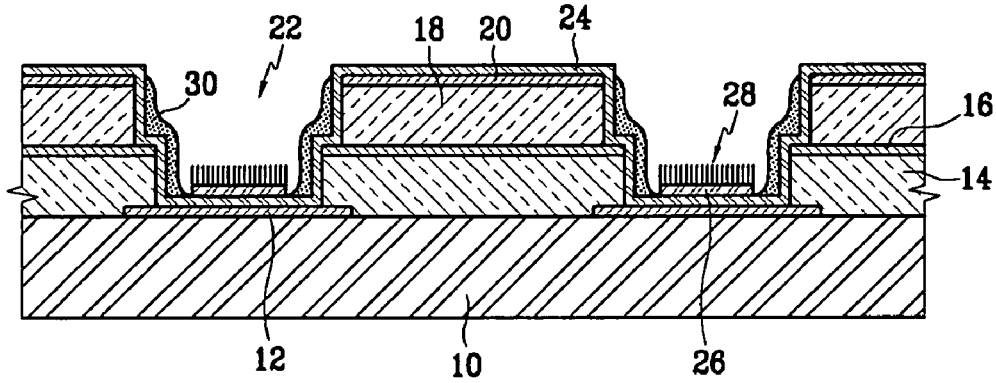

In one embodiment, as shown in FIG. 1C, carbonaceous materials such as carbon nanotubes are grown on the catalytic metal layers 26 through direct growth, such as arc-discharge, laser vaporization, plasma enhanced chemical vapor deposition, and thermal chemical vapor deposition, thereby forming electron emission regions 28. In an embodiment, the carbonaceous materials may include graphite, graphite nanofibers, diamond-like carbon, and $C_{60}$, in addition to the carbon nanotubes.

In one embodiment, the direct growth may include plasma enhanced chemical vapor deposition, and thermal chemical vapor deposition. The plasma enhanced chemical vapor deposition has an advantage in that it can synthesize a carbonaceous material at 550° C. or less, which is the heat distortion temperature of the soda lime glass mainly used as the substrate of the electron emission device. By contrast, the thermal chemical vapor deposition has an advantage in that it is well adapted to the synthesis of a large amount of a high purity carbonaceous material, and easily controls a micro structure in a simplified way.

In an embodiment, with the applications of the plasma enhanced chemical vapor deposition and the thermal chemical vapor deposition, the catalytic metal layers 26 are surface-etched before the synthesis of the carbonaceous material thereon using ammonia gas and hydrogen gas to form nanometer-sized catalytic metal particles on the surface of the catalytic metal layers 26. This is because the carbonaceous material is synthesized on the micro catalytic metal particles.

In one embodiment, with the plasma enhanced chemical vapor deposition, the glow discharge is generated within a chamber or a reactor by way of the direct current applied to both electrodes or a high frequency power supply to thereby synthesize a carbonaceous material from the micro metallic particles of the catalyst layers, using a reaction gas such as $C_2H_2$, $CH_4$, $C_2H_4$, $C_2H_6$, and CO. In an embodiment, with the thermal chemical vapor deposition, the substrate 10 is mounted within a quartz reaction tube with a built-in heating coil, and a reaction gas is blown into the quartz reaction tube, thereby synthesizing a carbonaceous material from the micro metallic particles of the catalytic metal layers 26.

In an embodiment, a carbonaceous material is synthesized from the catalytic metal layers 26 based on direct growth to form electron emission regions 28. In this process, unintended carbon remnants 30 are generated, and deposited on the surface of the conductive layer 24 at the sidewall of the openings 22.

Figure 1D:
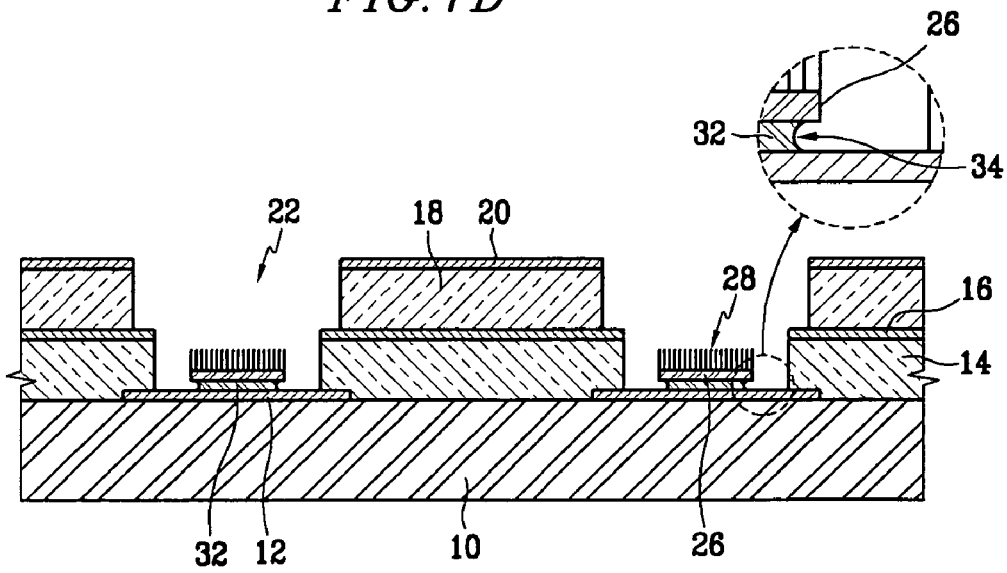

In one embodiment, the portions of the conductive layer 24 except for the portion thereof placed under the catalytic metal layer 26 are exfoliated, and removed together with the carbon remnants deposited thereon. Then, as shown in FIG. 1D, the conductive layer placed under the catalytic metal layer 26 becomes a catalytic buffer layer 32.

In one embodiment, with the patterning of the conductive layer 24, a wet etching may be used in such a way that the substrate 10 is dipped in a conductive layer etching solution to remove the portions of the conductive layer 24 not covered by the catalytic metal layers 26. The catalytic metal layers 26 have the role of a mask such that the catalytic buffer layers are selectively formed under the catalytic metal layers 26.

In an embodiment, furthermore, when the conductive layer 24 is patterned through the wet etching, over-etching may be made to generate the so-called under-cuts below the peripheries of the catalytic metal layers 26. The reference numeral 34 of FIG. 1D refers to the locations of the under-cuts. In this way, the carbon remnants around the electron emission regions 28 are effectively removed, and the catalytic buffer layer 32 only has a role of electrically connecting the cathode electrode 12 to the catalytic metal layer 26.

As described above, with the method according to one embodiment, the carbon remnants incidentally generated during the process of synthesizing a carbonaceous material on the catalytic metal layers 26 are exfoliated, and removed together with the patterning of the conductive layer 24, thereby preventing the withstanding voltage characteristics of the electron emission device from being deteriorated due to the carbon remnants.

An additional method of manufacturing an electron emission device according to an embodiment of the invention will be now explained with reference to FIGS. 2A to 2D.

Figure 2A:
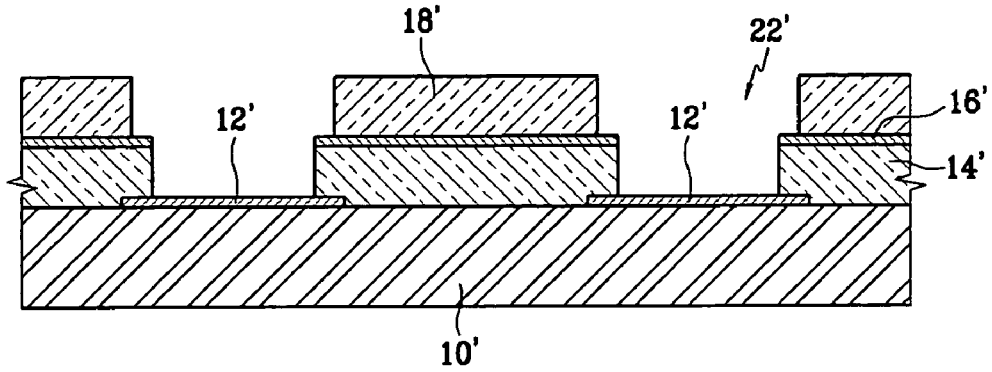
FIGS. 2A to 2D are partial sectional views of an electron emission device according to an embodiment of the invention, illustrating the respective steps of processing an electron emission device.

In one embodiment, as shown in FIG. 2A, a conductive layer is formed on a substrate 10', and patterned to thereby form stripe-shaped cathode electrodes 12'. An insulating material is deposited or printed onto the cathode electrodes 12' over the entire area of the substrate 10' through chemical vapor deposition or screen printing to form a first insulating layer 14'. A conductive layer is formed on the first insulating layer 14', and patterned to thereby form stripe-shaped gate electrodes 16' crossing the cathode electrodes 12'.

In an embodiment, an insulating material is deposited or printed on the gate electrodes 16' over the entire area of the substrate 10' through chemical vapor deposition or screen printing to form a second insulating layer 18'. The second insulating layer 18', the gate electrodes 16' and the first insulating layer 14' are sequentially partially-etched to thereby form openings 22' partially exposing the surface of the cathode electrodes 12'.

Figure 2B:
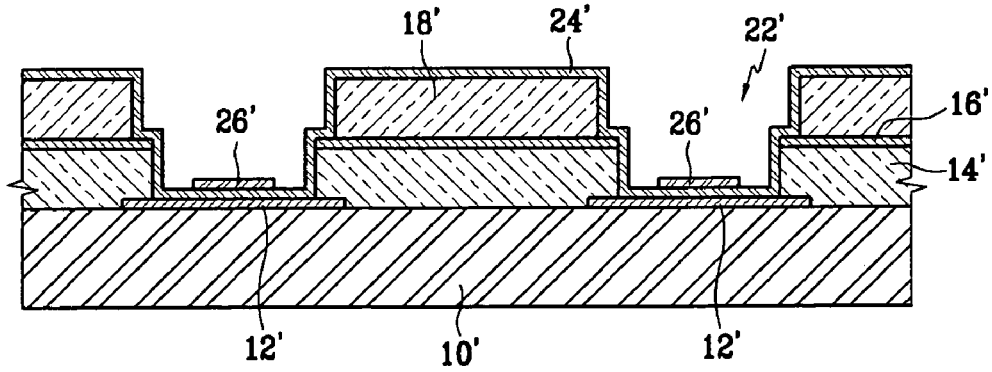

In an embodiment, as shown in FIG. 2B, a conductive material is coated onto the entire surface of the structure of the substrate 10' to form a conductive layer 24'. Catalytic metal layers 26' are selectively formed over the cathode electrodes 12' and the conductive layer 24' at the locations which will have electron emission regions. The materials for the conductive layer 24' and the catalytic metal layers 26' may be the same as those related to the embodiments above.

Figure 2C:
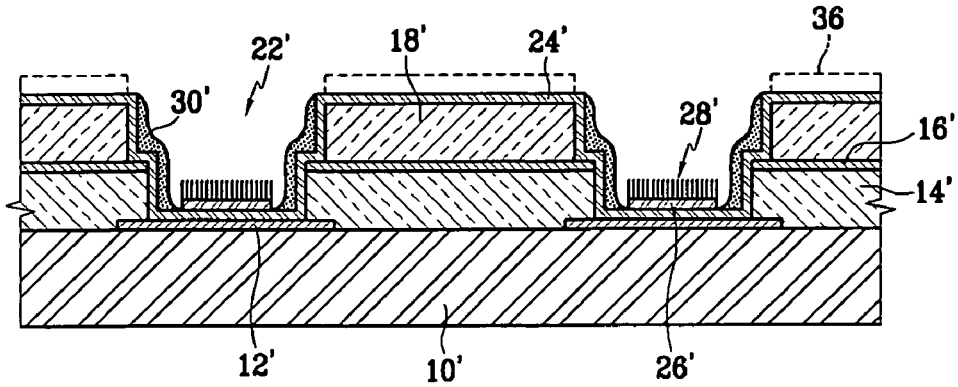

In an embodiment, as shown in FIG. 2C, carbonaceous materials such as carbon nanotubes are grown on the catalytic metal layers 26' to form electron emission regions 28'. In this process, unintended carbon remnants 30' are generated, which are deposited on the surface of the conductive layer 24' at the sidewall of the openings 22'. The specific contents of the direct growth technique and the materials for the electron emission regions 28' may be the same as those related to the embodiments above.

Figure 2D:
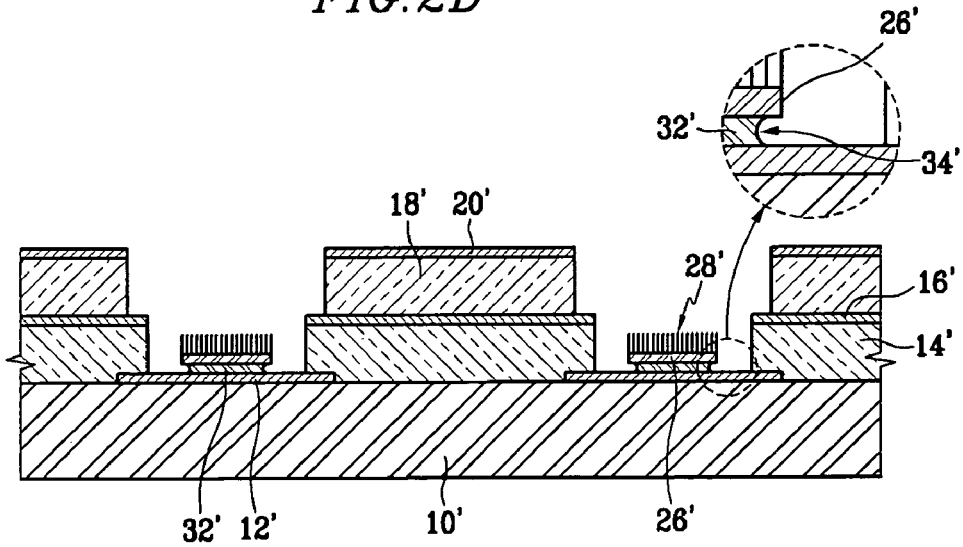

In one embodiment, the portions of the conductive layer 24' except for the portions thereof placed under the catalytic metal layer 26' and over the second insulating layer 18' are exfoliated, and removed together with the carbon remnants deposited thereon. Then, as shown in FIG. 2D, the conductive layer left under the catalytic metal layer 26' become a catalytic buffer layer 32', while the conductive layer left over the second insulating layer 18' becomes a focusing electrode 20'.

In one embodiment, a wet etching technique may be used to pattern the conductive layer 24' such that a mask layer 36 shown in FIG. 2C is formed on the conductive layer 24' over the second insulating layer 18', and the substrate 10' is dipped in a conductive layer etching solution, thereby removing the portions of the conductive layer 24' not covered by the mask layer 36 and the catalytic metal layers 26'. In this case, the catalytic metal layers 26' have the role of a mask layer such that catalytic buffer layers 32' are formed under the catalytic metal layers 26'.

Furthermore, in one embodiment when the conductive layer 24' is patterned through wet etching, over-etching may generate under-cuts below the peripheries of the catalytic metal layers 32'. The reference numeral 34' of FIG. 2D refers to the locations of the under-cuts. In an embodiment, the carbon remnants 30' are removed once through the patterning of the conductive layer 24', and simultaneously, the catalytic buffer layer 32' and the focusing electrode 20' are formed.

Figure 3:
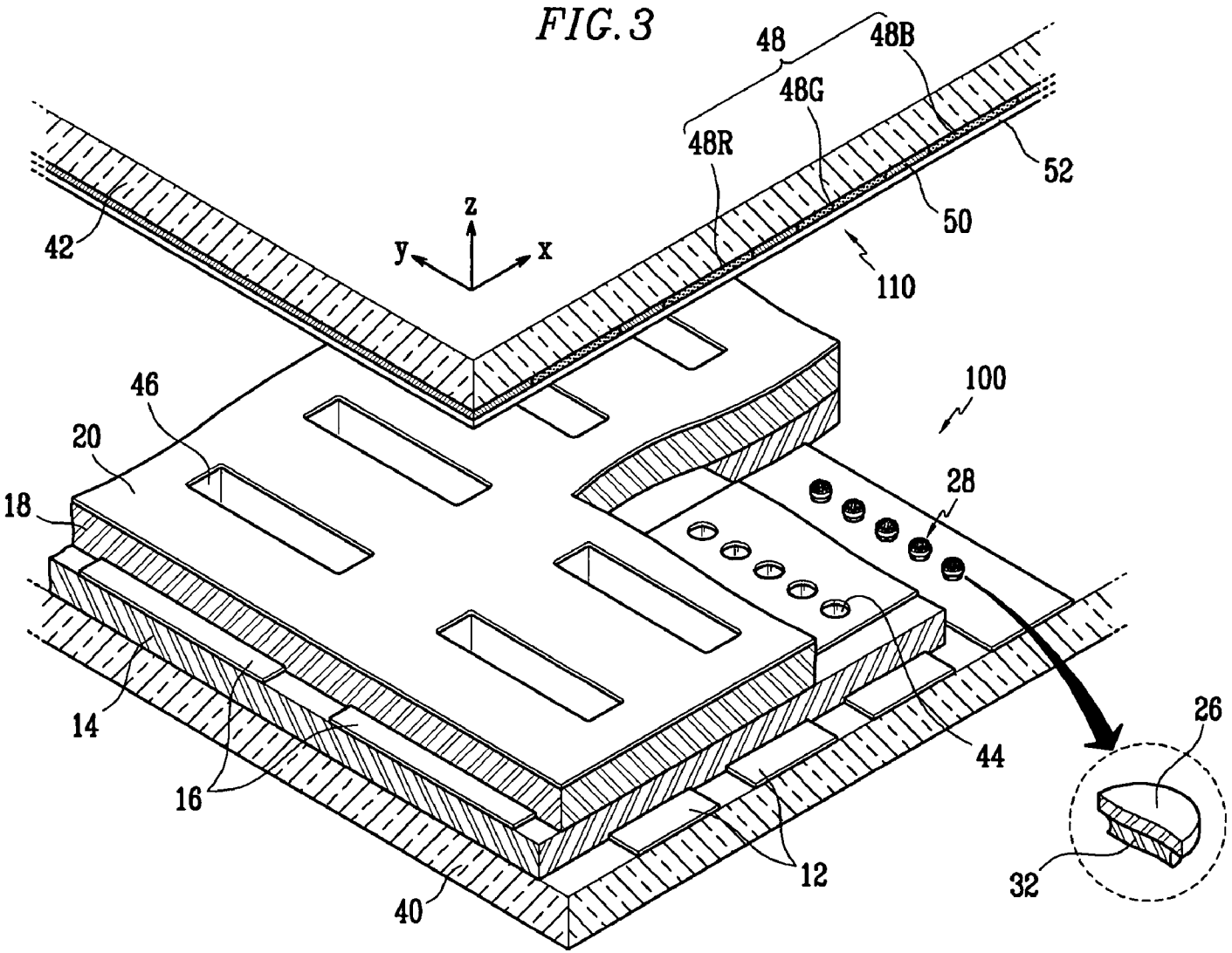
FIG. 3 is a partial exploded perspective view of an electron emission display according to an embodiment of the invention.

FIG. 3 shows an electron emission display using the electron emission device manufactured through one embodiment of the invention.

As shown in FIG. 3, an electron emission display according to an embodiment includes first and second substrates 40 and 42 facing each other in parallel at a predetermined distance. A sealing member (not shown) is provided at the peripheries of the first and the second substrates 40 and 42 to seal them, and the inner space between those substrates is evacuated to be at $10^{-6}$ Torr such that the first and the second substrates 40 and 42 and the sealing member make formation of a vacuum cell.

In one embodiment, electron emission elements are arranged on the surface of the first substrate 40 facing the second substrate 42 while forming arrays to construct an electron emission device 100 in association with the first substrate 40. The electron emission device 100 is assembled with the second substrate 42 and a light emission unit 110 provided on the second substrate 42 to thereby construct an electron emission display.

In an embodiment, first cathode electrodes 12 and gate electrodes 16 are patterned in stripes perpendicular to each other, on the first substrate 40 separated by a first insulating layer 14. In one embodiment, when the crossing regions of the cathode and the gate electrodes 12 and 16 are defined as pixels, one or more electron emission regions 28 are formed on the cathode electrodes 12 at the respective pixels.

In an embodiment, the electron emission regions 28 are formed with carbonaceous materials, such as carbon nanotubes, graphite, graphite nanofibers, diamond-like carbon, and $C_{60}$. The electron emission regions 28 are formed on the catalytic metal layers 26, and catalytic buffer layers 32 are disposed between the cathode electrodes 12 and the catalytic metal layers 26 to electrically interconnect them.

In one embodiment, the catalytic metal layers 26 may be formed with (Fe), nickel (Ni), cobalt (Co), or an alloy thereof. As the catalytic buffer layer 32 has a peripheral under-cut, the width of the catalytic buffer layer 32 is substantially smaller than that of the catalytic metal layer 26. In an embodiment, the catalytic buffer layer 32 has selective etching characteristics in that the etching solution for the catalytic buffer layer 32 differs from that for the catalytic metal layer 26. In another embodiment, the catalytic buffer layer 32 may be formed with molybdenum (Mo), aluminum (Al), silver (Ag), or chromium (Cr).

In one embodiment, a second insulating layer 18 and a focusing electrode 20 are formed on the gate electrodes 16 and the first insulating layer 14. In an embodiment, the focusing electrode 20 is formed with the same material as the catalytic buffer layer 32.

In one embodiment, the focusing electrode 20, the second insulating layer 18, the gate electrodes 16 and the first insulating layer 14 each have openings exposing the electron emission regions 28 on the first substrate 40. For example, it is illustrated in FIG. 3 that five openings 44 are formed on the gate electrode 16 and the first insulating layer 14 at each pixel, and one opening 46 is formed on the focusing electrode 20 and the second insulating layer 18 at that pixel.

In an embodiment, phosphor layers 48 with red, green and blue phosphor layers 48R, 48G and 48B are formed on a surface of the second substrate 42 facing the first substrate 40 such that they are spaced apart from each other with a distance, and a black layer 50 is formed between the neighboring phosphor layers 48 to enhance the screen contrast. In one embodiment, an anode electrode 52 is formed on the phosphor and the black layers 48 and 50 with a layer based on a metallic material such as aluminum Al.

The anode electrode 52 receives a high voltage that is required to accelerate the electron beams from the outside to place the phosphor layers 48 in a high potential state, and reflects the visible rays radiated from the phosphor layers 48 to the first substrate 40 toward the second substrate 42, thereby enhancing the screen luminance.

In one embodiment, the anode electrode may be formed with a transparent conductive layer based on indium tin oxide (ITO), instead of the metallic layer. The anode electrode is placed on a surface of the phosphor and the black layers 48 and 50 are directed toward the second substrate 42. In an embodiment, the transparent conductive layer and the metallic layer are simultaneously used to form the anode electrode.

In an embodiment, a plurality of spacers (not shown) are arranged between the first and the second substrates 40 and 42 to endure the pressure applied to the vacuum vessel and to maintain a constant distance between the two substrates. The spacers are located corresponding to the black layer 50 such that they do not intrude into the area of the phosphor layers 48.

The above-structured electron emission display is driven by applying predetermined voltages to the cathode electrodes 12, the gate electrodes 16, the focusing electrode 20 and the anode electrode 52 from the outside.

In an embodiment, any one of the cathode and the gate electrodes 12 and 16 receives a scan driving voltage to function as a scan electrode, and the other electrode receives a data driving voltage to function as a data electrode. In an embodiment, the focusing electrode 20 receives 0V or a negative direct voltage of several volts to less than 100 volts, required for focusing the electron beams, and the anode electrode 52 receives a positive direct current voltage of several hundred to several thousand volts, required for accelerating the electron beams.

Then, at the pixels where the voltage difference between the cathode and the gate electrodes 12 and 16 exceeds the threshold value, electric fields are formed around the electron emission regions 28, and electrons are emitted from those electron emission regions 28. The emitted electrons are focused at the center of the bundle of electron beams while passing through the opening 46 of the focusing electrode 20, and attracted by the high voltage applied to the anode electrode 52, followed by colliding into the phosphor layers 48 at the relevant pixels to emit light.

Although embodiments of the invention have been described in detail hereinabove, it should be clearly understood that many variations and/or modifications of the basic inventive concept herein taught which may appear to those skilled in the art will still fall within the spirit and scope of the invention, as defined in the appended claims and their equivalents.

What is claimed is:

1. An electron emission device comprising:

a substrate;

cathode electrodes on the substrate;

gate electrodes on the substrate such that the gate electrodes are insulated from the cathode electrodes;

catalytic buffer layers on the cathode electrodes at predetermined locations thereof;

catalytic metal layers on the catalytic buffer layers, wherein the catalytic buffer layers have peripheral under-cuts such that a width of a catalytic buffer layer is substantially smaller than a width of the corresponding catalytic metal layer; and electron emission regions provided with a carbonaceous material grown from the catalytic metal layers.

2. The electron emission device of claim 1, wherein the electron emission regions comprise a material selected from the group consisting of carbon nanotubes, graphite, graphite nanofibers, diamonds, diamond-like carbon, $C_{60}$, and combinations thereof.

3. The electron emission device of claim 1, wherein the catalytic buffer layer and the catalytic metal layer comprise conductive materials, the catalytic metal layer is etchable using a first etching solution, and the catalytic buffer layer is etchable using a second etching solution different from the first etching solution.

4. The electron emission device of claim 3, wherein the catalytic metal layer comprises a material selected from the group consisting of iron, nickel, cobalt, alloys thereof, and combinations thereof, and the catalytic buffer layer comprises a material selected from the group consisting of molybdenum, aluminum, silver, chromium, and combinations thereof.

5. The electron emission device of claim 1, further comprising a focusing electrode on the cathode electrodes and the gate electrodes, wherein the focusing electrode comprises the same material as the catalytic buffer layer.

6. An electron emission display comprising:

first and second substrates facing each other;

cathode electrodes provided on the first substrate;

gate electrodes provided on the first substrate such that the gate electrodes are insulated from the cathode electrodes;

catalytic buffer layers provided on the cathode electrodes at predetermined locations thereof;

catalytic metal layers provided on the catalytic buffer layers, wherein the catalytic buffer layers have peripheral under-cuts such that a width of the catalytic buffer layer is substantially smaller than a width of the corresponding catalytic metal layer;

electron emission regions provided with a carbonaceous material grown from the catalytic metal layers;

phosphor layers provided on the second substrate; and an anode electrode provided on a surface of the phosphor layers.

7. The electron emission display of claim 6, wherein the catalytic buffer layer and the catalytic metal layer comprise conductive materials, the catalytic metal layer is etchable using a first etching solution, and the catalytic buffer layer is etchable using a second etching solution different from the first etching solution.

8. The electron emission display of claim 6, further comprising a focusing electrode provided over the cathode electrodes and the gate electrodes, wherein the focusing electrode comprises the same material as the catalytic buffer layer.

* * * * *